US006368130B1

(12) United States Patent
Fukuda

(10) Patent No.: US 6,368,130 B1
(45) Date of Patent: Apr. 9, 2002

(54) CONNECTOR ADAPTED TO ABSORB A POSITIONAL MISALIGNMENT

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/573,199

(22) Filed: May 18, 2000

(30) Foreign Application Priority Data

Jun. 10, 1999 (JP) ..... 11-164178

(51) Int. Cl.[7] ..... H01R 13/52
(52) U.S. Cl. ..... 439/271; 439/364
(58) Field of Search ..... 439/271, 247, 439/586, 587, 595, 598

(56) References Cited

U.S. PATENT DOCUMENTS

| | | | | |
|---|---|---|---|---|
| 4,998,889 A | | 3/1991 | Moly | 439/247 |
| 5,108,303 A | * | 4/1992 | Maeda et al. | 439/271 |
| 5,197,898 A | * | 3/1993 | Nagamine | 439/271 |
| 5,492,487 A | * | 2/1996 | Cairns et al. | 439/273 |
| 5,713,761 A | * | 2/1998 | Okayasu | 439/595 |
| 5,779,493 A | * | 7/1998 | Tomita et al. | 439/271 |
| 5,913,697 A | * | 6/1999 | Myer et al. | 439/595 |
| 6,102,740 A | * | 8/2000 | Murakami et al. | 439/598 |

FOREIGN PATENT DOCUMENTS

| | | | |
|---|---|---|---|
| JP | 3-43974 | 2/1991 | |
| JP | 6-15274 | 2/1994 | |
| JP | 6-62478 | 9/1994 | |
| UA | 2 193 853 A | 2/1988 | H01R/13/74 |

* cited by examiner

*Primary Examiner*—Khiem Nguyen
*Assistant Examiner*—Brian S. Webb
(74) *Attorney, Agent, or Firm*—Morgan, Lewis & Bockius LLP

(57) ABSTRACT

A connector includes a connector housing including a terminal accommodating main body portion in which a plurality of terminals are partitioned and arranged for accommodation, an outer circumferential wall portion provided at predetermined distance away from said terminal accommodating main body portion to surround said terminal accommodating main body portion, a bottom portion for coupling said outer circumferential wall portion to said terminal accommodating main body portion, a waterproof positional misalignment absorbing member provided in a space between said terminal accommodating main body and said outer circumferential wall portion, and a cover member including an insertion leg portion inserted into said space via said waterproof positional misalignment absorbing member, an accommodating portion having an opening in a front thereof so as to allow said terminal accommodating main body portion to be accommodated therein and a positional misalignment absorbing gap is provided between said insertion leg portion and one of said outer circumferential wall portion and said terminal accommodating main body portion so that said connector housing and said cover member can freely move relative to each other when said terminal accommodating main body portion is fitted in a mating connector.

6 Claims, 11 Drawing Sheets

CONNECTOR ADAPTED TO ABSORB A POSITIONAL MISALIGNMENT

BACKGROUND OF INVENTION

1. Field of Invention

The present invention relates to a connector and more particularly to the provision of a connector which can absorb a positional misalignment with a mating connector so as to improve the efficiency in a connector coupling operation and can provide superior waterproofness.

2. Related Art

An electric connector unit is, for example, disclosed in JP-A-3-43974 in which a plurality of female connectors are set in a cover such that the cover is then bolted so that the plurality of female connectors are collectively fitted on mating connectors in one action.

As shown in FIGS. 12 and 13, such an electric connector unit has a first connector cover 105 in which three first connectors 101, 102, 103 are accommodated and arranged respectively in connector accommodating chambers 104 partitioned with bulkheads and a second connector cover 110 in which second connectors 106, 107, 108 adapted to fit respectively on the first connectors 101, 102, 103 are also accommodated and arranged respectively in connector accommodating chambers 109 partitioned with bulkheads, whereby the first connectors 101, 102, 103 and second connectors 106, 107, 108 are fitted to each other and the first connector cover 105 and second connector cover 110 are fastened to each other with a fastening bolt 111.

As shown in FIG. 12, the first connectors 101, 102, 103 each comprise a connector housing 112, a pair of plate-like resilient packings adapted to hold the connector housing 112 from the front and back thereof and a box-like locking member 114. These first connectors 101, 102, 103 are designed to be fitted in the respective connector accommodating chambers 104 formed in the first connector cover 105 so as to be accommodated and arranged therein.

On the other hand, as shown in FIG. 12, too, the second connectors 106, 107, 108 each comprise a connector housing 115 which is made unitary and a frame-like resilient packing 116. These second connectors are designed to be fitted in the respective connector chambers 109 formed in the second connector cover 110 so as to be accommodated and arranged therein.

With the electric connector unit constructed as described above, the first connectors 101, 102, 103 and the second connectors 106, 107, 108, which are constructed so as to establish a plurality of paired relationships can be fitted to each other through a single operation of tightening the fastening bolt 111, whereby the connecting operation of the first connectors 101, 102, 103 and the second connectors 106, 107, 108 can be facilitated.

In the aforesaid electric connector, however, the first connectors 101, 102, 103 are accommodated and arranged in the respective connector chambers 104, whereas the second connectors 106, 107, 108 are formed integrally with the connector housing 115. With this construction, any positional misalignment between the first connectors 101, 102, 103 and the second connectors 106, 107, 108 prevents the designed fit and makes more difficult the connector coupling operation than otherwise constructed.

In order to facilitate the connector coupling operation, the first connectors 101, 102, 103 and the second connectors 106, 107, 108 are required to be highly accurately arranged, and the dimensions of those connectors are also required to be highly accurate. To make these happen, the cost for respective constituent parts needed to realize the aforesaid accurate construction becomes high and this eventually increases the total production cost of the connector unit.

SUMMARY OF INVENTION

The present invention was made to solve the above problems, and an object thereof is to provide a connector that can improve the efficiency in a connector coupling operation by absorbing a positional misalignment with a mating connector and which is inexpensive and superior in waterproofness.

With a view to solving the above problems, according to a first feature of the invention, there is provided a connector comprising a connector housing having a terminal accommodating main body portion in which a plurality of terminals are partitioned and arranged for accommodation, an outer circumferential wall portion provided a predetermined distance away from the terminal accommodating main body portion so as to surround the terminal accommodating main body portion and a bottom portion for coupling the outer circumferential wall portion to the terminal accommodating main body portion, a waterproof positional misalignment absorbing member provided in a space between the terminal accommodating main body and the outer circumferential wall portion, and a cover member having an insertion leg portion adapted to be inserted into the space via the waterproof positional misalignment absorbing member and an accommodating portion having an opening in a front thereof so as to allow the terminal accommodating main body portion to be accommodated therein, wherein a positional misalignment absorbing gap is provided between the insertion leg portion and the outer circumferential wall portion or the terminal accommodating main body portion so that the connector housing and the cover member can freely move relative to each other when the terminal accommodating main body portion is fitted in a mating connector.

Thus, in this construction, the space is provided in the connector housing for insertion thereinto of the insertion leg portion of the cover member, the waterproof positional misalignment absorbing member is disposed in the space, and the positional misalignment absorbing gap is provided between the insertion leg portion and the outer circumferential wall portion or the terminal accommodating main body portion so that the connector housing and the cover member can freely move relative to each other when the terminal accommodating main body portion of the connector housing is fitted in the mating connector. With this construction, even if there is occurring a positional misalignment between the connector housing and a connector housing of the mating connector, the connector housing and the cover member can move relative to each other so as to absorb the positional misalignment so occurring, whereby a smooth fit into the mating connector can be effected.

According to a second feature of the invention, wherein the waterproof positional misalignment absorbing member comprises a bottom sealing portion disposed at the bottom portion, a side sealing portion disposed between the terminal accommodating main body portion or the outer circumferential wall portion and the insertion leg portion so as to be brought into tight contact with a leading end portion of the mating connector and a projection provided on the side sealing portion in such a manner as to project therefrom so as to bias said insertion leg portion.

Since the waterproof positional misalignment absorbing member has the bottom sealing portion disposed at the bottom portion, in addition to the function of absorbing a positional misalignment between the connectors, the member functions to shut out water trying to penetrate into this space. In addition, since the waterproof positional misalignment absorbing member has the side sealing portion which is brought into tight contact with the leading end portion of the mating connector, the member can also shut out water trying to penetrate from between the terminal accommodating main body portion adapted to fit in the mating connector and the mating connector.

According to a third feature of the invention, wherein the waterproof positional misalignment absorbing member has a mounting projection provided on the bottom sealing portion and wherein the waterproof positional misalignment absorbing member is disposed in the space with the mounting projection being inserted into a through hole formed in the bottom portion.

Since the waterproof positional misalignment absorbing member allows the mounting projection provided at the bottom sealing portion to be inserted into the through hole formed in the bottom portion, the waterproof positional misalignment absorbing member can be surely positioned on the bottom portion, whereby an inadvertent dislocation thereof from the space can be prevented.

According to a fourth feature of the invention, wherein the accommodating portion has an outer circumferential wall surface portion, an inner circumferential wall surface portion provided inwardly of the outer circumferential wall surface portion and an insertion space formed between the outer circumferential wall surface portion and the inner circumferential wall surface portion and wherein a sealing member is disposed in the insertion space and an equipment hood portion having an opening in a front thereof so as to accommodate therein a mating connector secured to an equipment main body is also fitted in the insertion space, whereby the cover member and the equipment hood portion are sealed with the sealing member.

In this construction, the insertion space is formed in the accommodating portion of the cover member, and the sealing member is disposed in the insertion space and the equipment hood portion having an opening in the front thereof so as to accommodate therein the mating connector secured to the equipment main body is also fitted in the insertion space, whereby the cover member and the equipment hood portion are sealed with the sealing member. With this construction, the air-tight condition existing between the cover member and the equipment hood portion can be improved, whereby water trying to penetrate from the cover member into the interior thereof is shut out.

According to a fifth feature of the invention, wherein the accommodating portion has an outer circumferential wall surface portion, an inner circumferential wall surface portion provided inwardly of the outer circumferential wall surface portion and an insertion space formed between the outer circumferential wall surface portion and the inner circumferential wall surface portion and wherein an equipment hood portion having an opening in a front thereof so as to accommodate therein a mating connector secured to an equipment main body is fitted in the insertion space, whereby the cover member and the equipment hood portion are sealed with a sealing member provided in the vicinity of a leading end portion of the equipment hood portion.

Thus, the air-tight condition existing between the cover member and the equipment hood portion can be improved by sealing the cover member and the equipment hood portion with the sealing member provided in the vicinity of the leading end of the equipment hood portion, whereby water trying to penetrate from the cover member into the interior thereof is shut out.

According to a sixth feature of the invention, wherein a plurality of the connector housings are provided in the cover member.

Thus, even if the plurality of the connector housings are provided in the cover member, since the respective connector housings are movable relative to the cover member, as with the first feature of the invention, the connector housings and the cover member move relative to each other so as to absorb the positional misalignment to thereby provide a smooth fit with the mating connector.

DETAILED DESCRIPTION OF PREFERRED EMBODIMENTS

Referring to the accompanying drawings, an embodiment of the present invention will be described in detail below.

In this embodiment, the present invention is applied to a male connector adapted to be fitted in a female connector which is secured to an equipment main body, and a connector is realized which can absorb a positional misalignment with the mating connector by means of a core alignment mechanism even if such a positional misalignment occur between the female and male connectors when they are fitted to each other so as to improve the efficiency in a connector coupling operation and can provide improved waterproofness.

Construction of the Connector

In this embodiment, the present invention is embodied as a male connector in which 99 female terminals are arranged horizontally and vertically at predetermined intervals in a connector housing.

Figure 1:
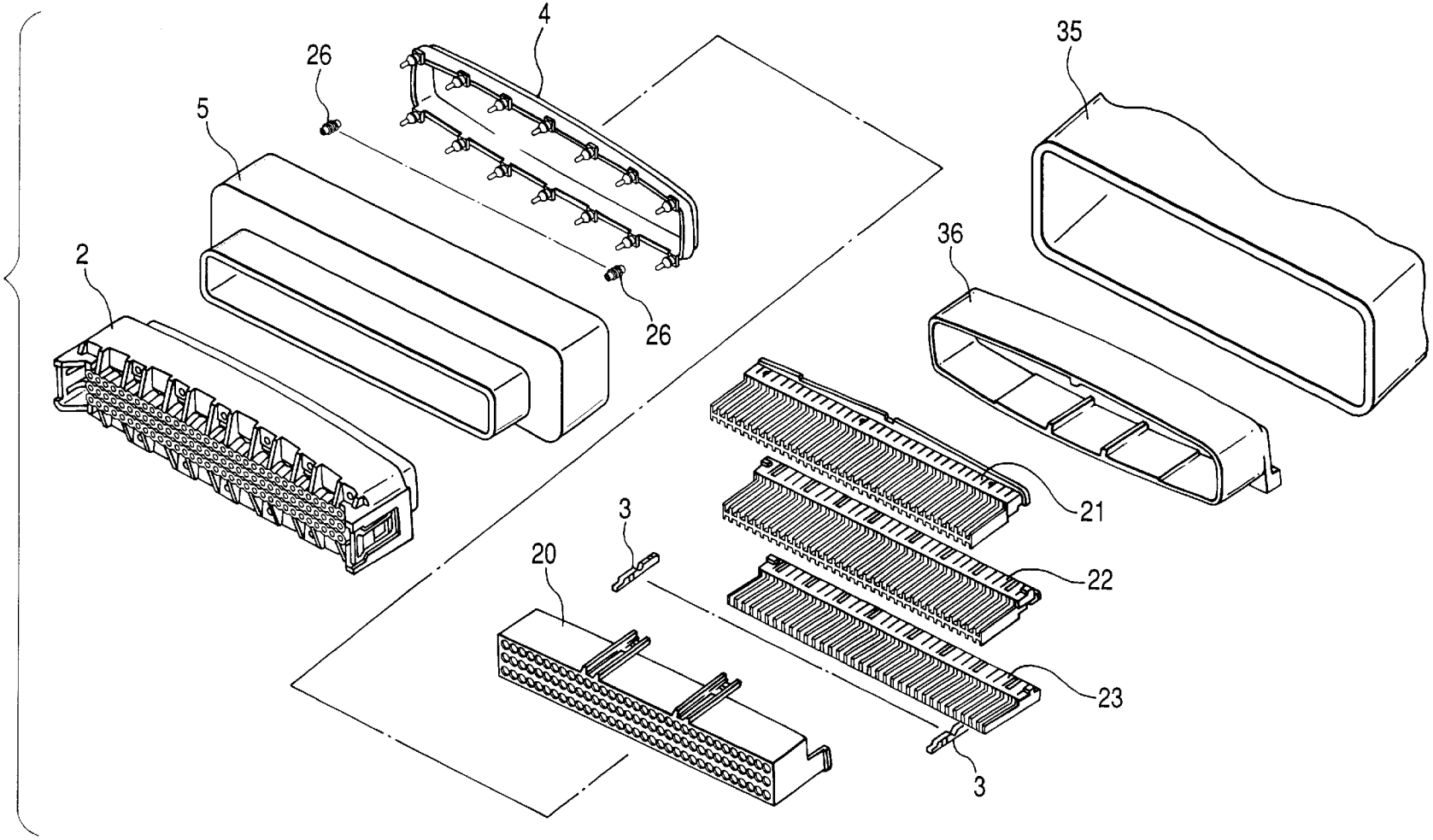
FIG. 1 is an exploded perspective view of a connector.
Figure 4:
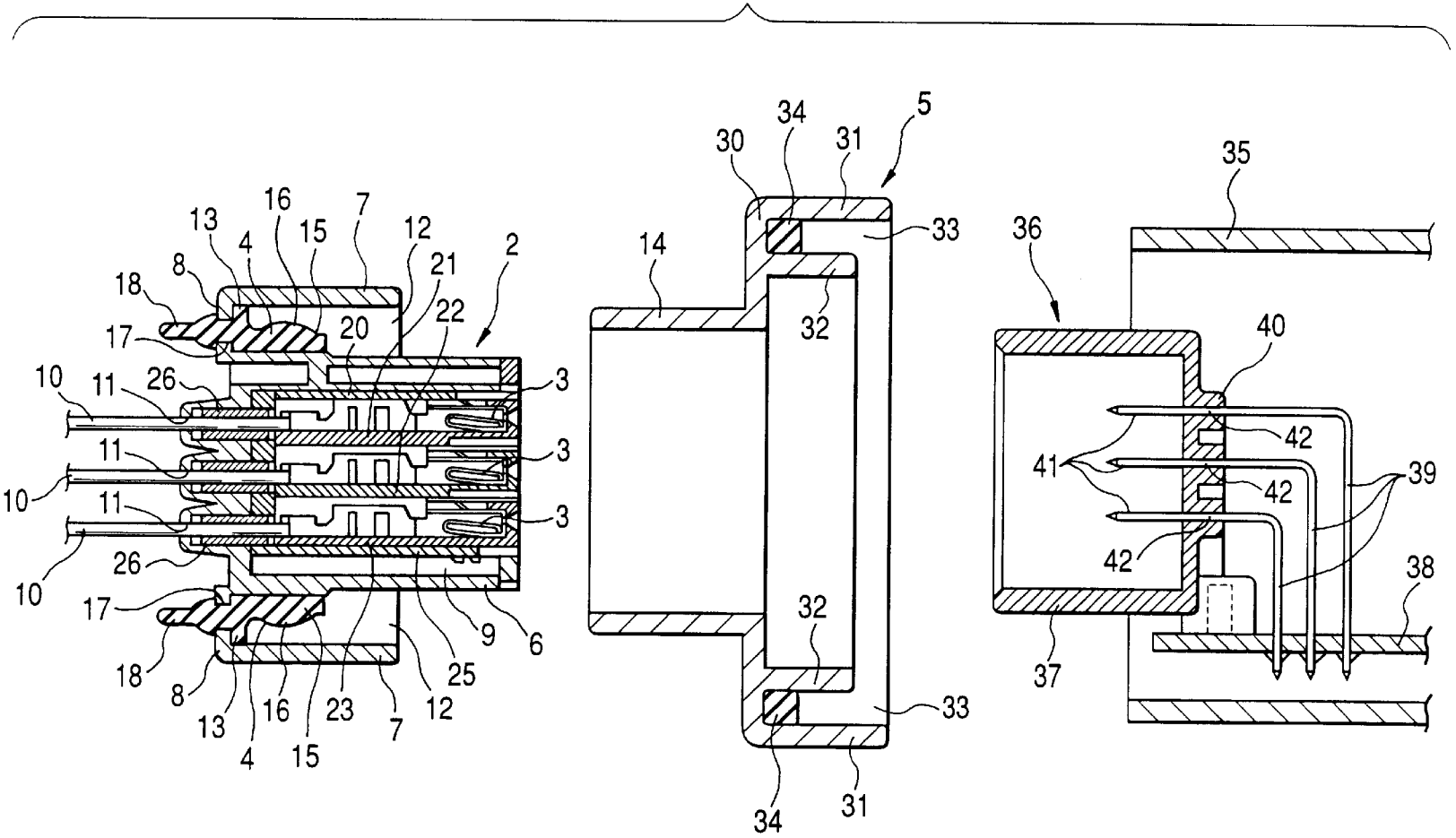
FIG. 4 is an exploded sectional view of the connector.
Figure 5:
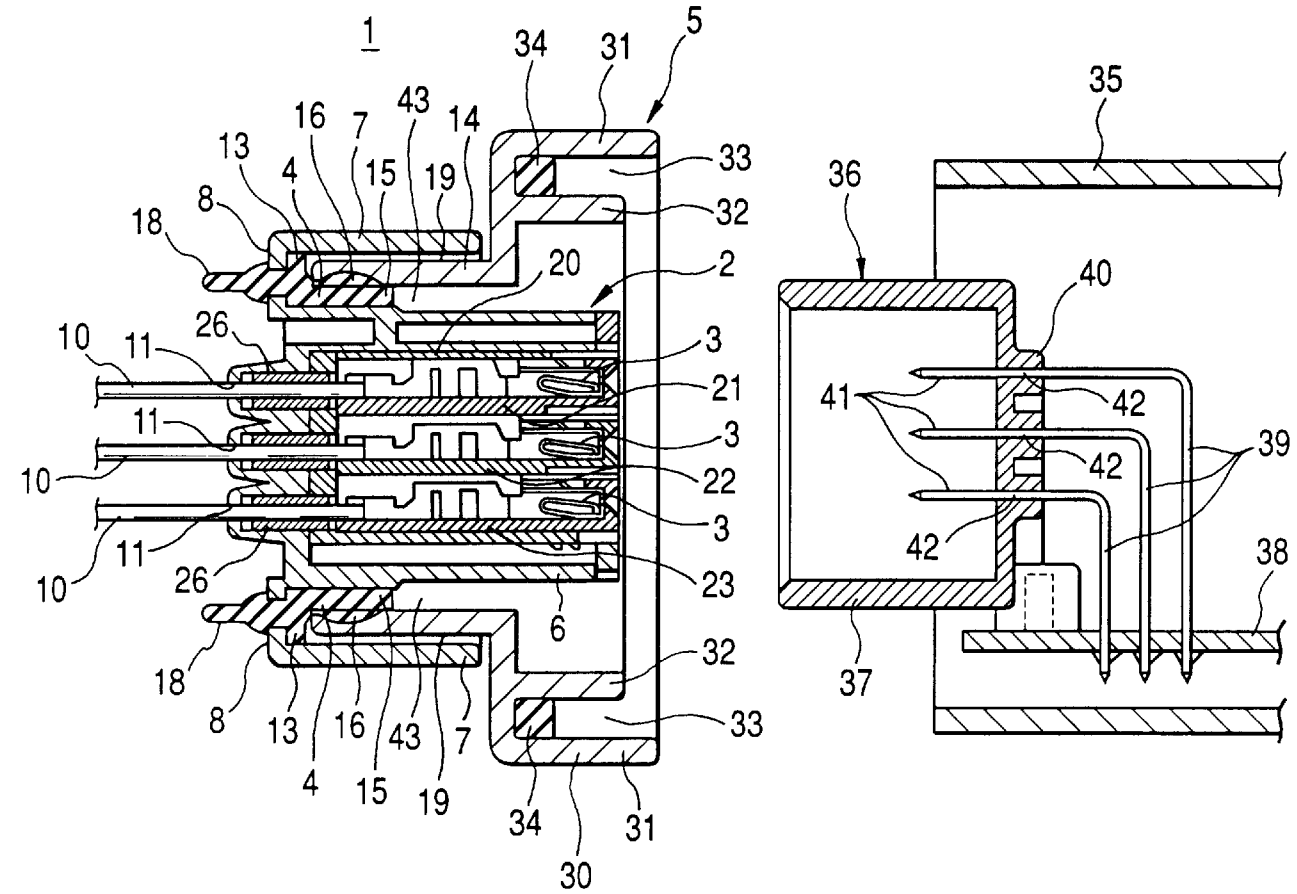
FIG. 5 is a sectional view showing a male connector and a female connector.

As shown in FIG. 1 and FIGS. 4 and 5, this male connector 1 comprises a connector housing 2, a plurality of female terminals 3 accommodated and arranged in this connector housing 2, a waterproof positional misalignment absorbing member 4 and a cover member 5 member adapted to be mounted on the connector housing 2.

Construction of the Connector Housing

Figure 2:
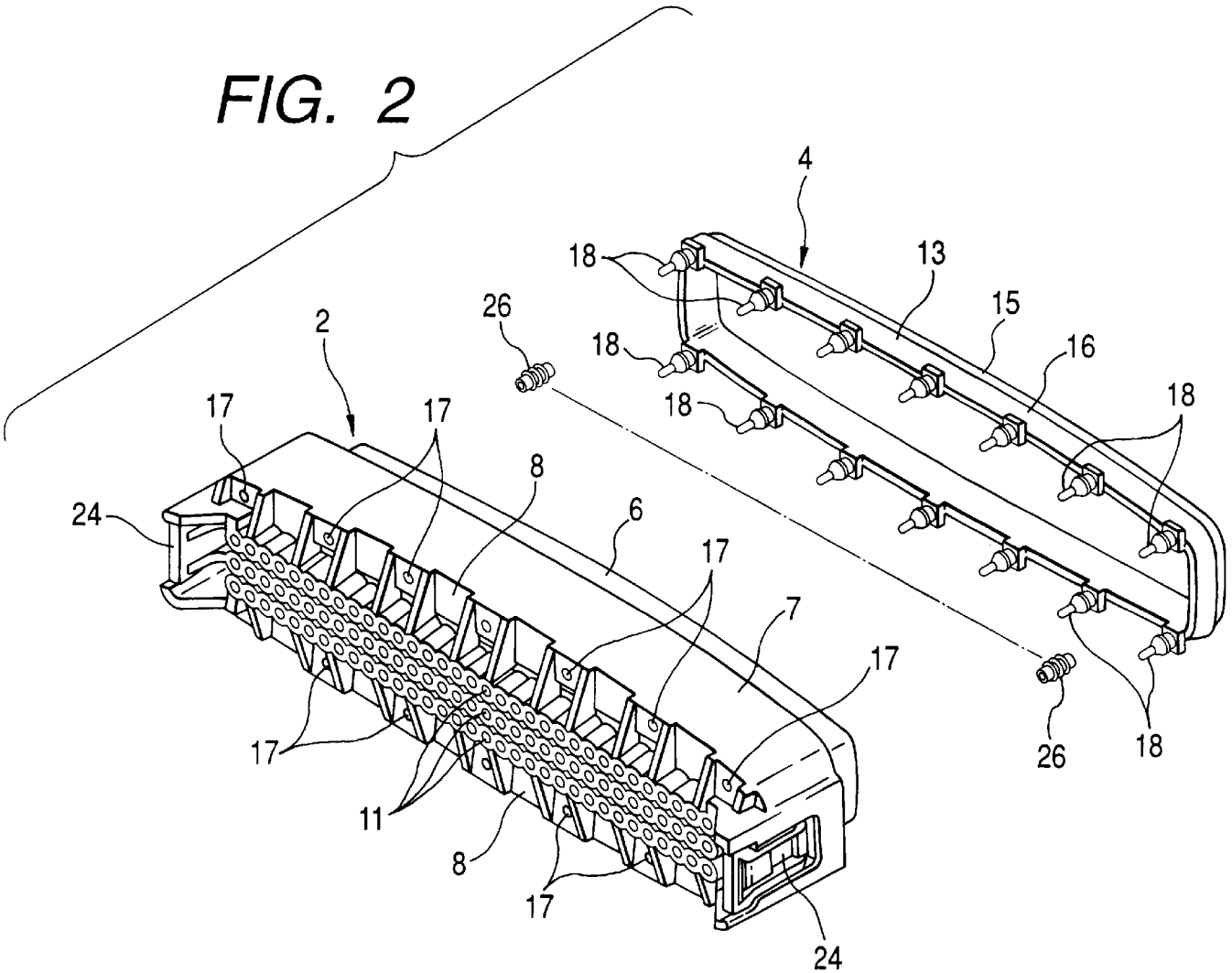
FIG. 2 is a perspective view showing a connector housing, a rubber seal and a waterproof positional misalignment absorbing member.

As shown in FIGS. 2 and 4, the connector housing 2 comprises terminal accommodating main body portion 6 in which the plurality of female terminals 3 are partitioned and arranged for accommodation, an outer circumferential wall portion 7 provided at a predetermined distance from the terminal accommodating main body portion 6 so as to surround the same and a bottom portion 8 connecting this outer circumferential wall portion 7 to the terminal accommodating main body portion 6.

As shown in FIGS. 2 and 4, this terminal accommodating main body portion 6 is formed as a rectangular parallelepiped having a terminal accommodating chamber 9 for allowing the plurality of female terminals 3 to be accommodated and arranged therein. Lead wire insertion holes 11 are formed in a bottom of the terminal accommodating main body portion 6 for allowing lead wires to be put therethrough. These lead wire insertion holes 11 are arranged in horizontal and vertical rows in such a manner as to correspond to the number of female terminals 3 provided, and are formed as through holes which communicate with the terminal accommodating chamber 9.

A tubular rubber seal 26 is provided on the circumference of a lead wire 10 that is to be inserted through the lead wire insertion hole 11, and the lead wire 10 is inserted through the lead wire insertion hole 11 together with the rubber seal 26.

As shown in FIGS. 2 and 4, the outer circumferential wall portion 7 is formed such that it surrounds the terminal accommodating main body portion 6 with the predetermined distance being provided therebetween. This outer circumferential wall portion 7 is also formed as an outer circumferential wall having a height which allows a side portion and a leading end of the terminal accommodating main body portion 6 to be exposed. Then, this outer circumferential wall portion 7 is connected integrally to the terminal accommodating main body portion 6 by the bottom portion 8 formed like a flange projecting from the outer circumference of the terminal accommodating main body portion 6, whereby a space 12 is formed between the terminal accommodating main body portion 6 and itself where accommodated and arranged is a waterproof positional misalignment absorbing member 4, which will be described later.

An engagement locking portion 24 is formed on either side of the outer circumferential wall portion 7 for engagement with a locking member (not shown) formed on the cover member 5 for locking the engagement between the connector housing 2 and the cover member 5.

Construction of the Waterproof Positional Misalignment Absorbing Member

Figure 6:
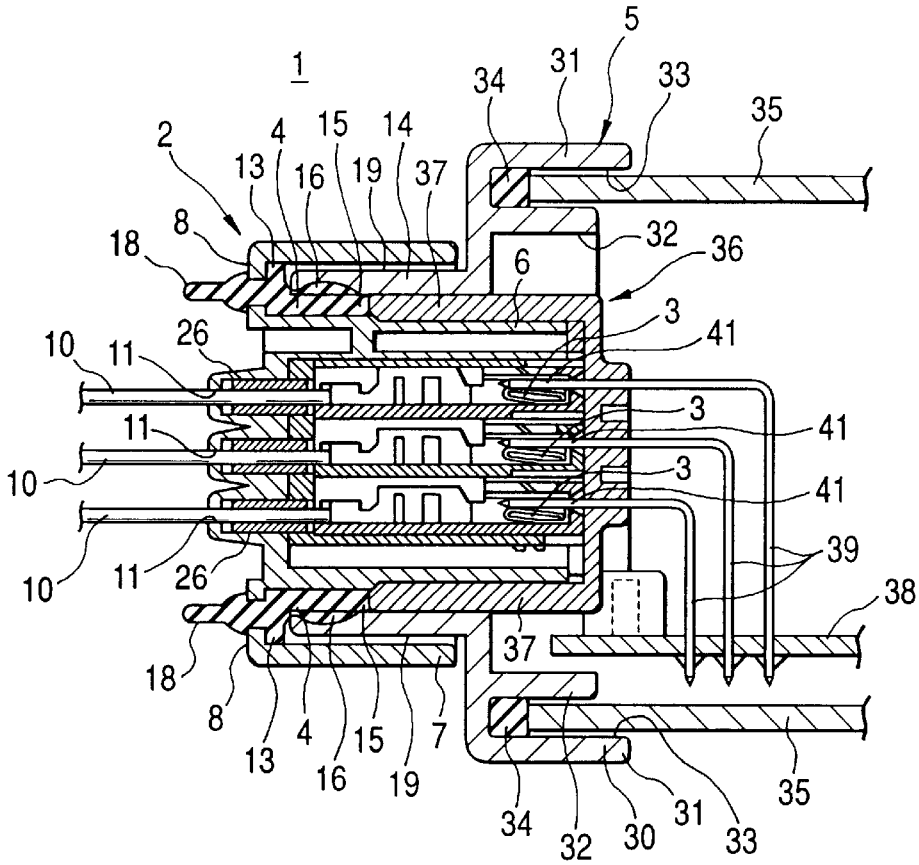
FIG. 6 is a sectional view showing a state in which the male connector and the female connector are fitted to each other.

As shown in FIGS. 2 and 6, the aforesaid waterproof positional misalignment absorbing member 4 is formed as a rectangular frame configuration of a size allowing the same member to be accommodated and arranged in the space 12 and is formed of a rubber member having a certain elasticity. This waterproof positional misalignment absorbing member 4 comprises a bottom sealing portion 13 disposed at the bottom portion 8, a side sealing portion 15 disposed between the terminal accommodating main body portion 6 and an insertion leg portion 14 of the cover member 5, which will be described later, for tight contact with a leading end portion of the mating connector, a projection 16 provided on the side sealing portion 15 in such a manner as to project therefrom so as to bias the insertion leg portion 14 and a mounting projection 18 provided on the bottom portion 8 for insertion into a through hole 17.

As shown in FIG. 4, the bottom sealing portion 13 functions as a seal for shutting out water trying to enter into the space 12 through a gap between the outer circumferential wall portion 7 and the insertion leg portion 14 of the cover member 5. The side sealing portion 15 is, as shown in FIG. 4, provided so as not only to rise perpendicularly to the bottom sealing portion 13 but also to be tightly attached to the outer circumference of the terminal accommodating main body portion 6, so that the side sealing portion 15 functions as a seal for shutting out water trying to penetrate from between the cover member 5 and the mating connector.

As shown in FIGS. 4 and 4, the projection 16 is provided on the side sealing portion 15 as a projection projecting toward the outer circumferential wall portion 7. This projection 16 is designed to pressingly bias the insertion leg portion 14 of the cover member 5 toward the outer circumferential wall portion 7 side. The height of the projection 16 is set such that even if the connector housing 2 or the cover member 5 moves relatively a distance corresponding to a gap formed as a positional misalignment absorbing gap 19 between the outer circumferential wall portion 7 and the insertion leg portion 14, the lap margin of the cover member 5 can be maintained.

Figure 3:
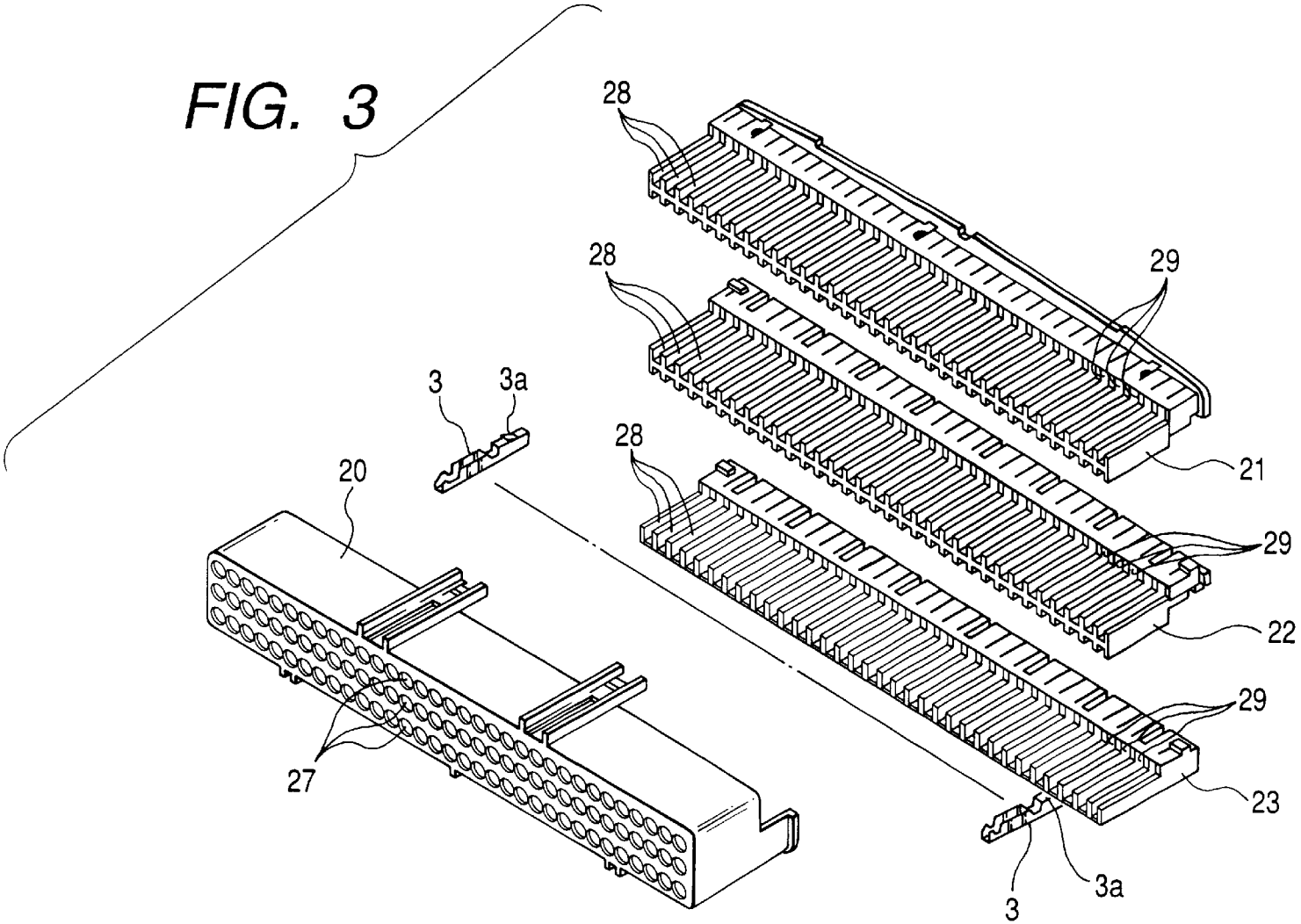
FIG. 3 is a perspective view showing a spacer, a female terminal and a bulkhead plate.

As shown in FIGS. 2 and 3, the mounting projection 18 is inserted into the through hole 17 formed in the bottom portion 8 so as to function to prevent the dislocation of the waterproof positional misalignment absorbing member 4 from the space 12. The mounting projection 18 is inserted from the space 12 via the through hole 17 so as to project from the opposite side at a leading end portion thereof. The through hole 17 is sealed with this mounting projection 18.

As shown in FIGS. 1 and 3, the terminal accommodating chamber 9 in the connector housing 2 is adapted to accommodate therein a spacer 20, an upper bulkhead plate 21, an intermediate bulkhead plate 22 and a lower bulkhead plate 23 which are all accommodated in the spacer 20 and the female terminals 3 adapted to be disposed in the respective upper bulkhead plate 21, intermediate bulkhead plate 22 and lower bulkhead plate 23.

Construction of the Spacer

As shown in FIGS. 3 and 4, the spacer 20 is formed as a rectangular parallelepiped having a configuration that can be fitted in the terminal accommodating chamber 9 and a bulkhead plate accommodating chamber camber 25. A plurality of insertion holes 27 are formed in a bottom of the spacer 20 for allowing lead wires 10 to be inserted therethrough for connection to the respective female connectors 3.

Construction of the Upper Bulkhead Plate 21, Intermediate Bulkhead Plate 22 and Lower Bulkhead Plate 23

As shown in FIG. 3, the female terminals 3 are accommodated and arranged at predetermined intervals in a horizontal row in the upper bulkhead plate 21, intermediate bulkhead plate 22 and lower bulkhead plate 23, respectively, and the adjacent female terminals 3 are constructed so as to be partitioned to thereby secure the electric insulation characteristics therebetween. Terminal accommodating portions 28 are formed longitudinally at predetermined intervals in the number corresponding to the number of the female terminals 3 for disposition of the female terminals 3 therein in the upper bulkhead plate 21, intermediate bulkhead plate 22 and lower bulkhead plate 23, respectively.

In addition, connecting portion holding portions 29 are formed in the upper bulkhead plate 21, intermediate bulkhead plate 22 and lower bulkhead plate 23 for fitting connecting portions 3*a* of the female terminals 3 therein to hold the female terminals 3. Then, the upper bulkhead plate 21, intermediate bulkhead plate 22 and lower bulkhead plate 23 in which the female terminals 3 are accommodated and arranged respectively are overlaid on each other in that order and are then press fitted into the bulkhead accommodating chamber 25 of the spacer 20 for accommodation therein.

Construction of the Cover Member

As shown in FIGS. 1 and 4, the cover member 5 comprises the insertion leg portion 14 that is inserted into the space 12 via the waterproof positional misalignment absorbing member 4 and an accommodating portion 30 having an opening in the front thereof so as to allow the terminal accommodating main body portion 6 to be accommodated in the interior thereof. The insertion leg portion 14 is formed as a frame unit of a rectangular parallelepiped and adapted to be inserted into the space 12. As shown in FIG. 6, a leading end portion of the insertion leg portion 14 is brought into tight attachment with the bottom sealing portion 13 of the waterproof positional misalignment absorbing member 4.

The aforesaid accommodating portion 30 is formed as a frame unit of a rectangular parallelepiped larger than the connector housing 2. This accommodating portion 30 has an outer circumferential wall surface portion 31, an inner circumferential wall surface portion 32 provided inwardly of the outer circumferential wall surface portion 31 and an insertion space 33 formed between the outer circumferential wall surface portion 31 and the inner circumferential wall surface portion 32.

The inner circumferential wall surface portion 32 is provided inwardly of the outer circumferential wall surface portion 31 and is made lower than the wall height of the outer circumferential wall surface portion 31. A sealing member 34 is provided at a bottom portion of the insertion space 33 formed between the outer circumferential wall surface portion 31 and the inner circumferential wall surface portion 32. This sealing member 34 is formed into a rectangular shape which corresponds to the shape of the cover member 5 and is constructed so as to fittingly receive therein an equipment hood portion 35 having an opening in the front thereof so as to allow the mating connector secured to the equipment main body to be accommodated therein. The sealing member 34 so constructed then functions to seal the cover member 5 and the equipment hood portion 35.

Construction-of the Female Connector

A female connector 36 which is the mating connector adapted to be fitted on the male connector described above is, as shown in FIGS. 1 and 4, provided in the equipment hood portion 35 of the equipment main body (not shown) and comprises a hood portion 37 and substrate-direct-attached terminals 39 soldered to an electronic substrate 38 built in the equipment main body.

As shown in FIG. 4, the hood portion 37 is formed as a rectangular frame unit for the terminal accommodating main body portion 6 to be fitted thereinto and an open leading end portion thereof is constructed so as to project from the equipment hood portion 35. Terminal insertion holes 42 are formed in a bottom portion 40 of the hood portion 37 so that contact portions 41 of the substrate-direct-attached terminals 39 project into the hood portion 37.

Operation of Mounting the Male Connector into the Female Connector

Described next will be an operation of mounting the male connector 1 constructed as described above into the female connector 36. As shown in FIG. 5, the male connector 1 in which the cover member 5 is assembled to the connector housing 2 is moved to approach the female connector 36 secured to the equipment main body. Then, the leading end of the terminal accommodating main body portion 6 of the connector housing 2 is first inserted into the hood portion 37 of the female connector 36.

When this occurs, even if a position misalignment is taking place between the connector housing 2 and the hood portion 37, since the relative movement of the cover member 5 and the connector housing 2 is allowed to take place over a distance corresponding to the positional misalignment absorbing gap 19 (a core alignment mechanism), the connector housing 2 and the cover member 5 move relative to each other to thereby absorb the position misalignment, whereby the terminal accommodating main body portion 6 is inserted into the hood portion 37 in a smooth fashion.

Then, when the male connector 1 continues to be push inserted into the female connector 36, the hood portion 37 enters into a hood portion fitting space 43 (refer to FIG. 5) formed between the terminal accommodating main body portion 6 and the cover member 5. After the hood portion 37 has entered into the hood portion fitting space 43, the respective contact portions 41 of the substrate-direct-attached terminals 39 in the hood portion 37 fit, respectively, in the female terminals 3 provided in the connector housing 2, whereby the respective female terminals 3 and the substrate-direct-attached terminals 39 connected thereto become conducting.

When, the male connector 1 continues to be further push inserted into the female connector 36, the hood portion 35 then enters into the insertion space 33 in the cover member 5, and finally, as shown in FIG. 6, the leading end of the hood portion 37 comes into tight attachment with the side sealing portion 15 of the waterproof positional misalignment absorbing member 4 and the leading end of the equipment hood portion 35 comes into tight attachment with the sealing member 34 provided in the insertion space 33 in the cover member 35, whereby water trying to penetrate into a portion where the male connector 1 and the female connector 36 are fitted together from between the cover member 5 and the hood portion 37 is shut out, and water trying to penetrate into a portion where the male connector 1 and the female connector 36 are fitted together from the insertion space 33 is also shut out, thereby making it possible to provide a highly reliable water-tight construction.

Figure 7:
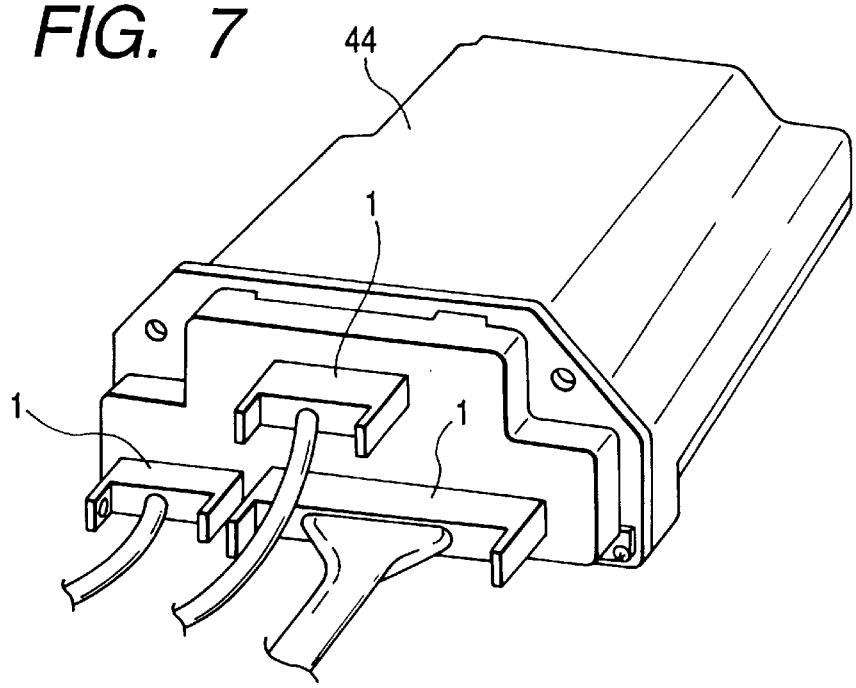
FIG. 7 is a perspective view showing an example in which a plurality of male connectors are attached to an equipment main body.

An example is shown in FIG. 7 in which the male connector 1 is attached to the female connector 36. FIG. 7 shows a state in which, for example, a plurality of female connectors 36 (not shown) are provided in an equipment main body 44 fixed inside the engine compartment of an automotive vehicle and respective male connectors 1 are attached to those female connectors 36.

In the male connector 1 constructed according to the embodiment of the present invention, the space 12 into which the insertion leg portion 14 of the cover member 5 is inserted is formed in the connector housing 2, and the waterproof positional misalignment absorbing member 4 is disposed in the space 12. Moreover, the positional misalignment absorbing gap 19 is formed between the insertion leg portion 14 and the outer circumferential wall portion 7 where the connector housing 2 and the cover member 5 are allowed to move relative to each other when the terminal accommodating main body portion 6 of the connector housing 2 is fitted in the hood portion 37 of the female connector. Thus, with this construction, even if a position misalignment is taking place between the connector housing 2 and the hood portion 37, the connector housing 2 and the cover member 5 move relative to each other to thereby absorb the position misalignment, whereby the male connector 1 can be fitted in the female connector 36 smoothly.

In addition, in the male connector according to the embodiment of the present invention, since the waterproof positional misalignment absorbing member 4 has the bottom sealing portion 13 disposed at the bottom portion 8, in addition to the function to absorb the position misalignment between the connectors, there is provided the function to shut out water trying to penetrate into the space 12. Moreover, the waterproof positional misalignment absorbing member 4 has the side sealing member 15 which is brought into tight contact with the leading end portion of the hood portion of the male connector 11 water is shut out which tries to penetrate from between the terminal accommodating main body portion 6 fitted in the female connector 36 and the hood portion 37.

Moreover, in the male connector 1 according to the embodiment of the present invention, since the mounting projection 18 provided on the bottom sealing portion 13 is allowed to be inserted through the through hole 17 formed in the bottom portion 8, the waterproof positional misalignment absorbing member 4 can be securely positioned at the bottom portion 8, whereby the inadvertent dislocation thereof from the space 12 can be prevented.

In addition, in the male connector 1 according to the embodiment of the present invention, the insertion space 33 is formed in the accommodating portion 30 of the cover member 5, the sealing member 34 is disposed in the insertion space 33, and the cover member 5 and the equipment hood portion 35 are sealed with the sealing member 34 by allowing the equipment hood portion 35 having an opening in the front thereof so as to accommodate therein the female connector 36 secured to the equipment main body to be fitted in the insertion space 33 as well. Thus, this construction improves the air-tight state between the cover member 5 and the equipment hood portion 35 to thereby shut out water trying to penetrate from the cover member 5 into the interior thereof.

Another Embodiment

While the specific embodiment of the present invention has been described heretofore, the present invention is not limited to the above embodiment but may be modified in various ways.

Figure 8:
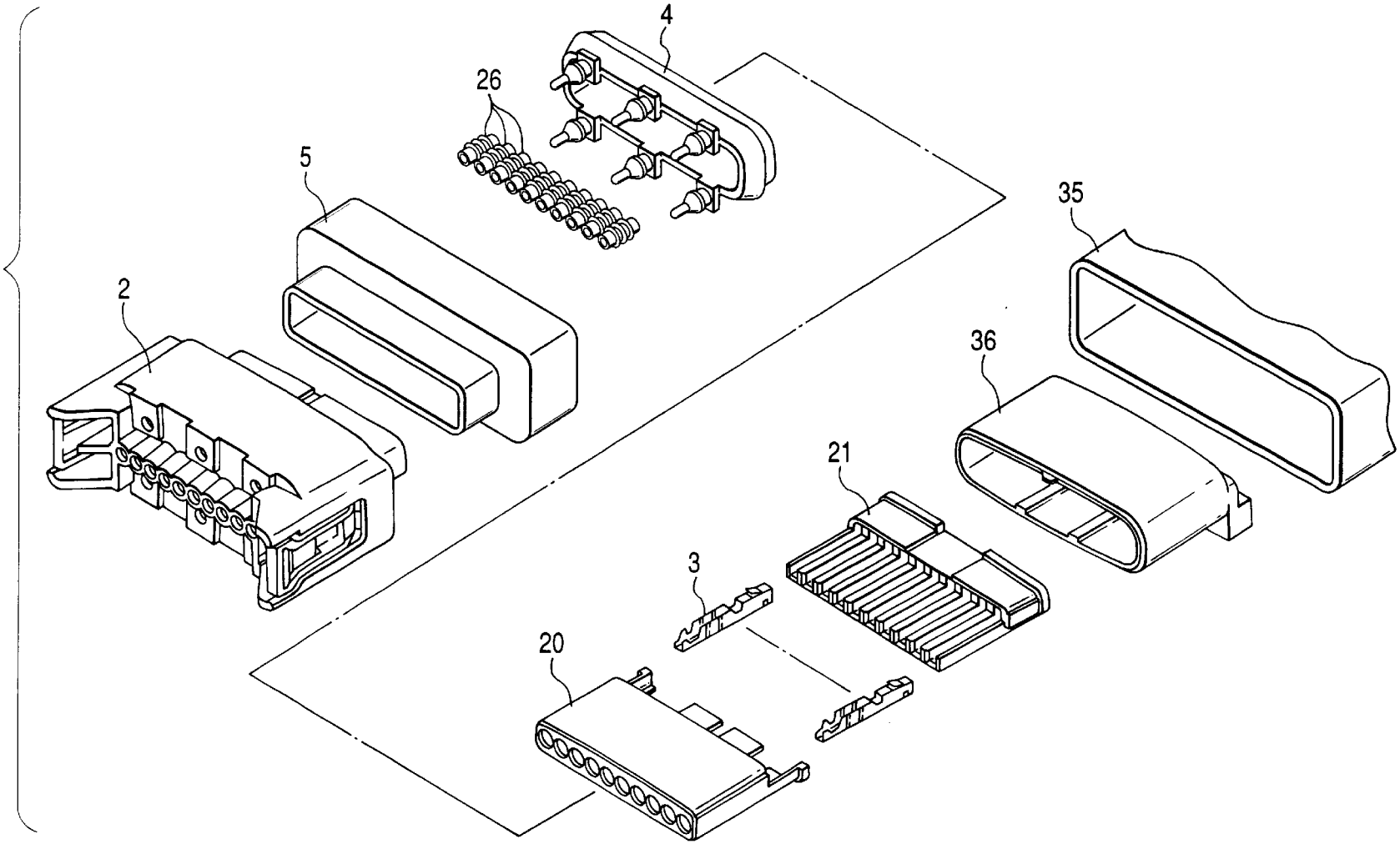
FIG. 8 is an exploded perspective view showing a connector of another type.
Figure 9:
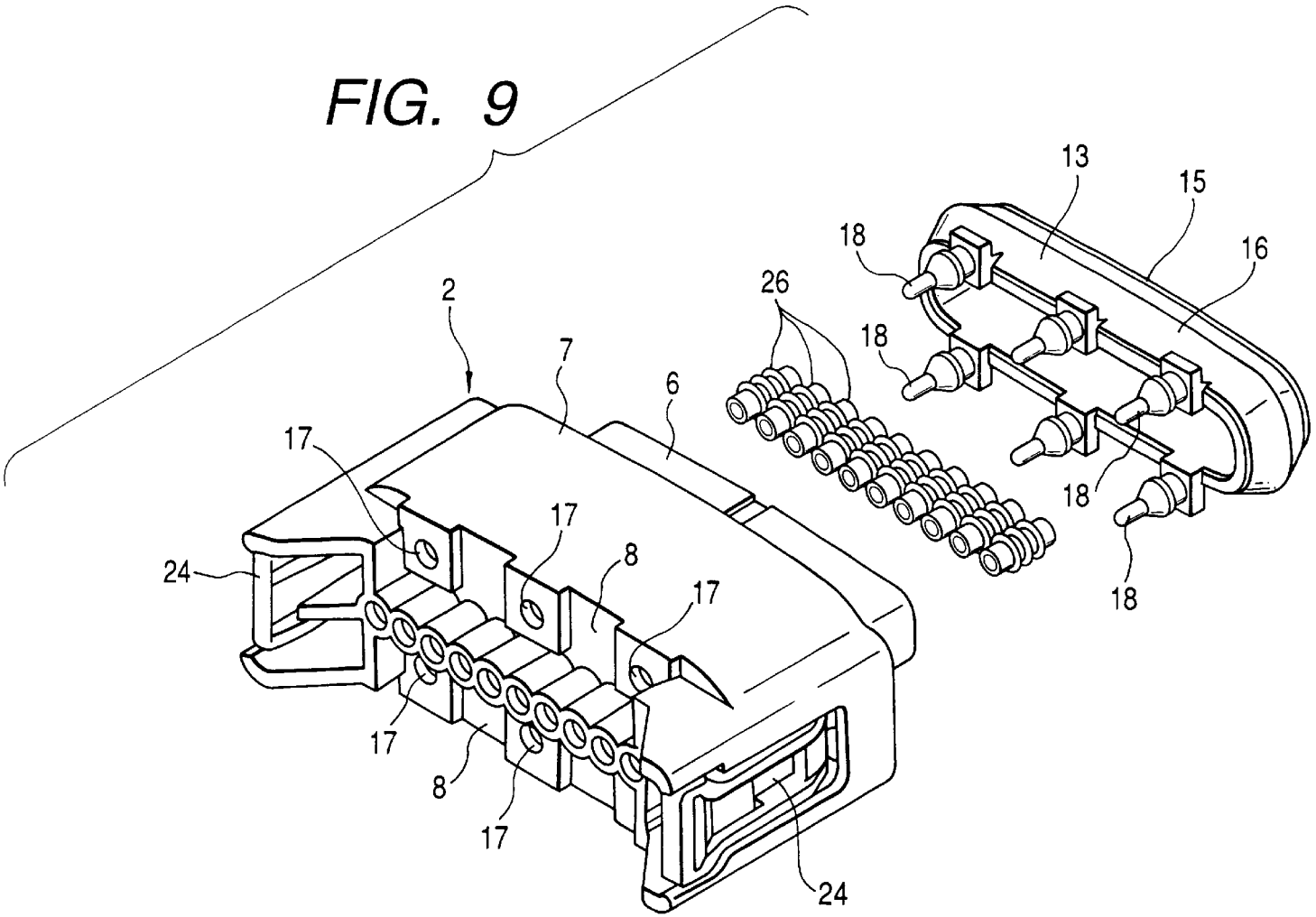
FIG. 9 is a perspective view showing a connector housing, a rubber seal and a waterproof positional misalignment absorbing member of the connector of another type.
Figure 10:
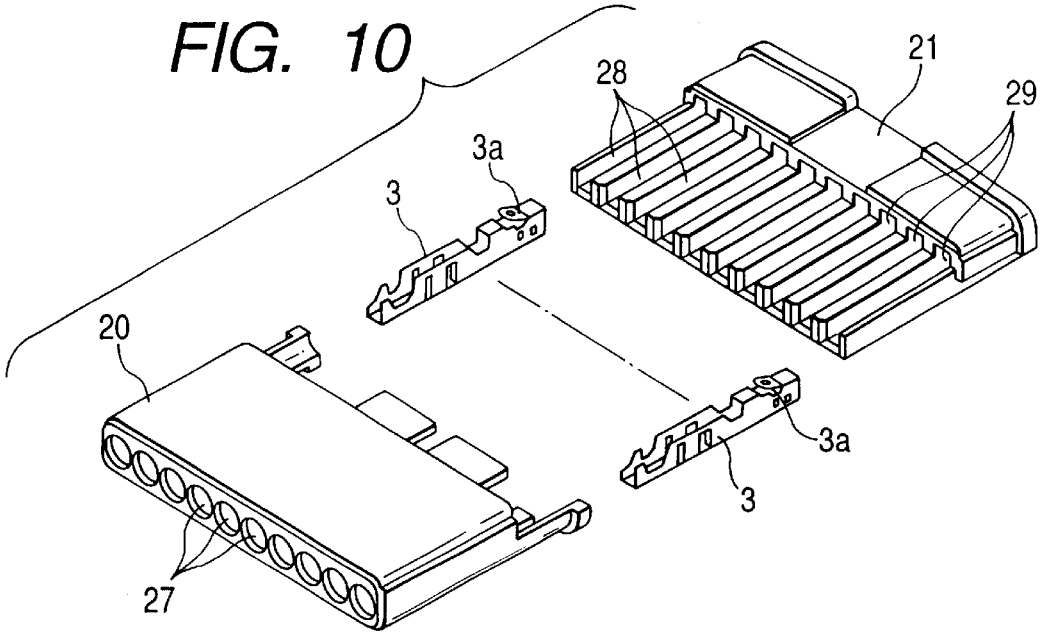
FIG. 10 is a perspective view showing a spacer, a female terminal and a bulkhead plate of the connector of another type.

For example, although the male connector of the aforesaid embodiment has 99 female connectors 3 arranged vertically and horizontally at the predetermined intervals in the connector housing 2, as shown in FIGS. 8 to 10, the same function and effect can be obtained when 10 female terminals 3 are arranged in a horizontal row. The construction of the male connector 1 in which 10 female terminals 3 are arranged in the connector housing 2 is identical to that of the male connector described in the previous embodiment, and therefore the description thereof will be omitted here to avoid a repeated description.

On top of that, in the previous embodiment, although the positional misalignment absorbing gap 19 is provided between the insertion leg portion 14 and the outer circumferential wall portion 71 the same function and effect can be obtained even when the gap 19 is provided between the insertion leg portion 14 and the terminal accommodating main body portion 6. In this case,the position where the side sealing portion 15 of the waterproof positional misalignment absorbing member 4 is formed is modified to a place where the side sealing portion 15 is brought into tight attachment with an internal wall surface of the outer circumferential wall portion 7.

Figure 11:
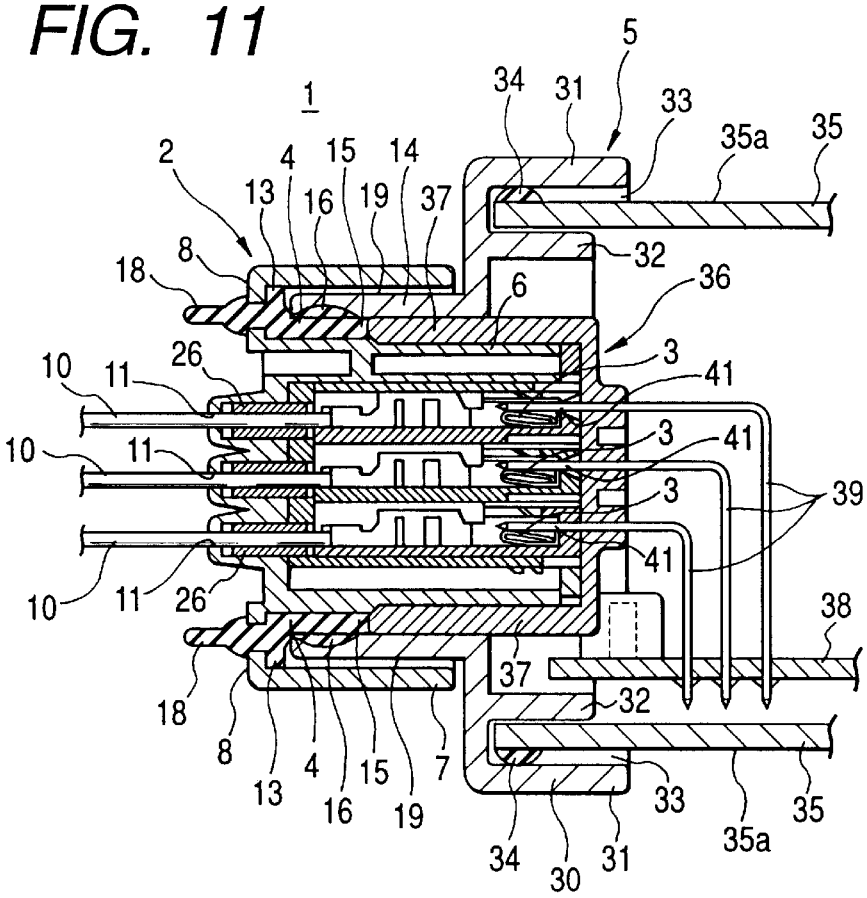
FIG. 11 is a sectional view showing a state in which a male connector and a female connector are fitted to each other with a sealing member being formed in the vicinity of a leading end of an equipment hood portion.
Figure 12:
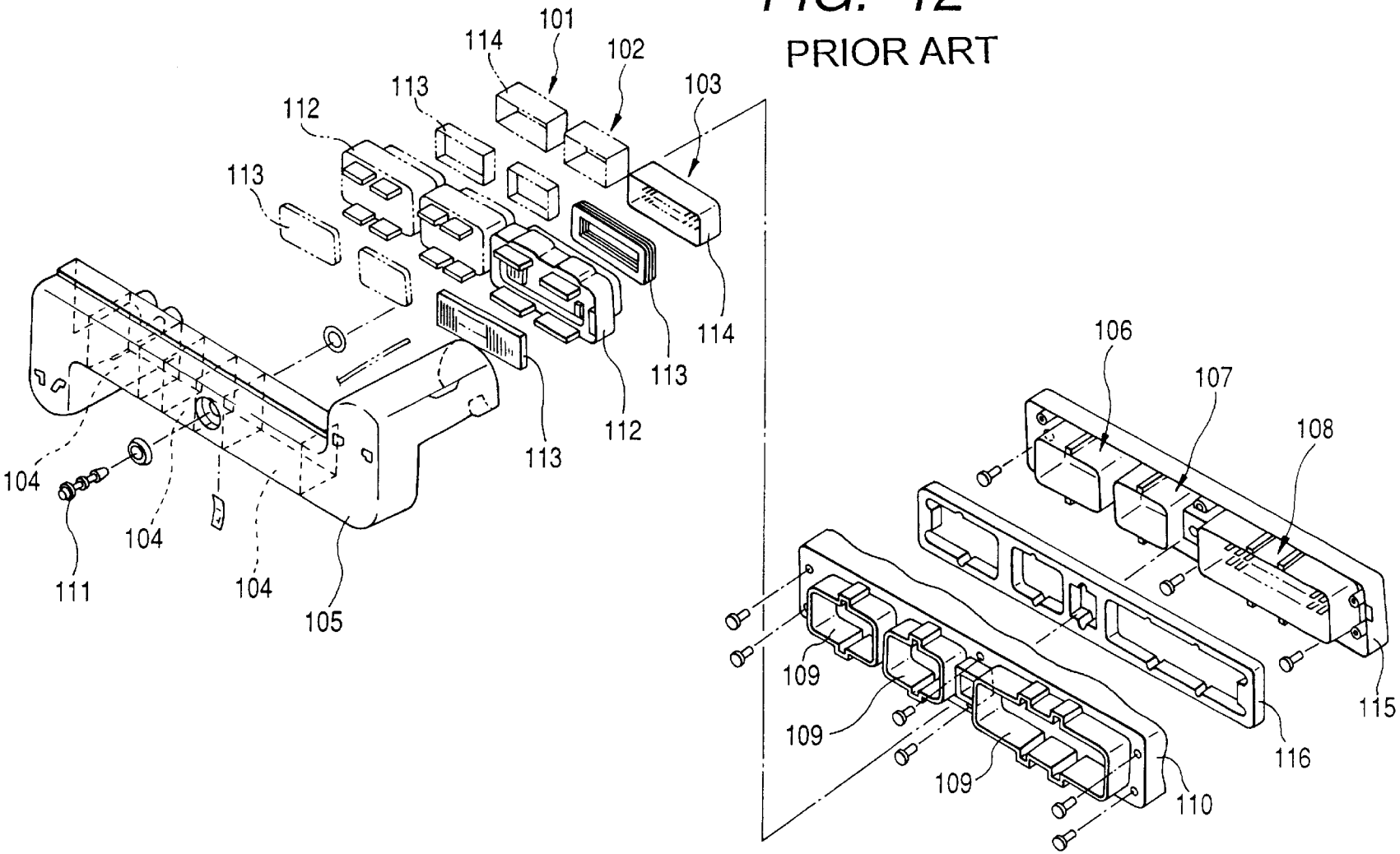
FIG. 12 PRIOR ART
FIG. 12 is an exploded perspective view of a conventional electric connector unit in which a plurality of male connectors and a plurality of female connectors are collectively fitted to each other with a single bolt
Figure 13:
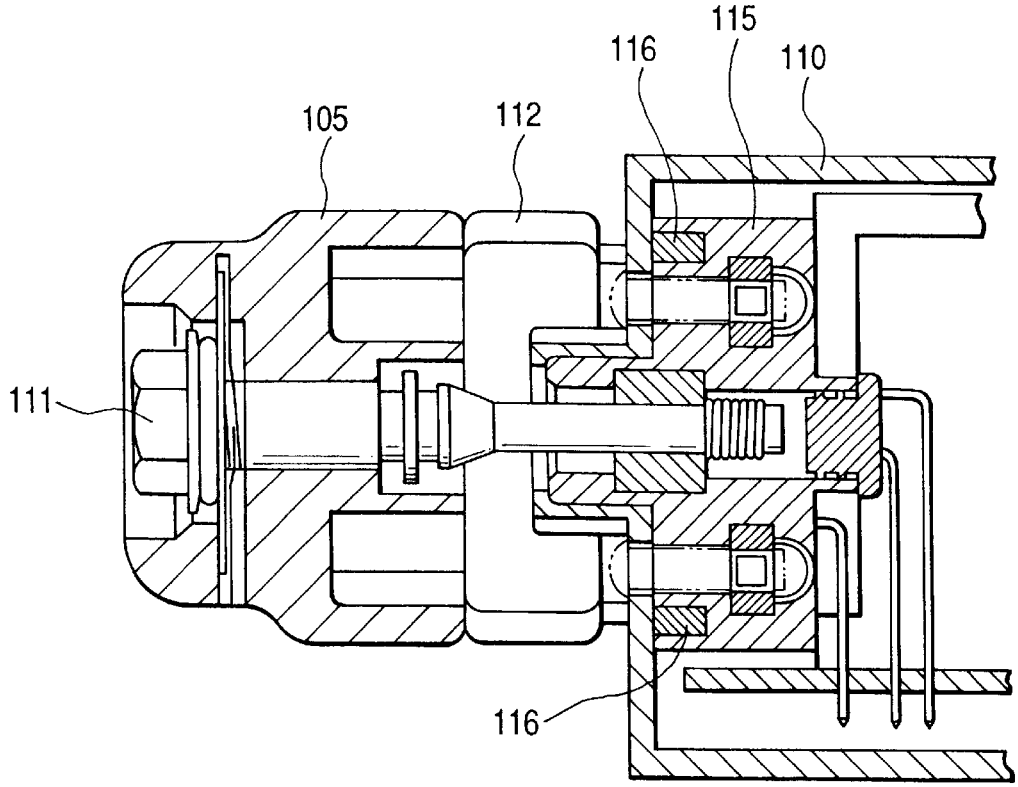
FIG. 13 PRIOR ART
FIG. 13 is an enlarged sectional view of the electric connector unit shown in FIG. 12.

In addition, as shown in FIG. 11, instead of providing the sealing member 34 in the insertion space 22 in the cover member 5, the sealing member 34 may be provided in the vicinity of the leading end of the equipment hood portion. In other words, the sealing member 34 is provided at a position in the vicinity of the leading end of the equipment hood portion on an external side 35a thereof which confronts the outer circumferential wall surface portion 31 of the cover member 5. This sealing member 34 is formed into a projection having an arc-like section so that the sealing member is brought into tight attachment with an internal surface of the outer circumferential wall surface portion 31 when the equipment hood portion 35 is inserted into the insertion space 33 to thereby seal the cover member 5 and the equipment hood portion 35.

Thus, the air-tight state between the cover member S and the equipment hood portion 35 is improved by sealing the cover member 5 and the equipment hood portion 35 with the sealing member 34 provided in the vicinity of the leading end of the equipment hood portion 35, thereby making it possible to shut out water trying to penetrate from the cover member 5 into the interior thereof.

In addition, in the previous embodiment, although only the single connector housing 2 attached to the cover member 5, a plurality of connector housings 2 may be attached to a cover member 5 which is enlarged in configuration in the aforesaid construction. In this case, of course, the insertion leg portion 4 and the accommodating portion 30 are formed in the cover member 5 in the number corresponding to the number of connector housings 2 so attached.

Thus, when the plurality of connector housings 2 are attached to the single cover member 5 in such a manner as to allow relative movements therebetween, the plurality of connector housings so attached can be fitted in mating connectors by performing a single attachment operation relative thereto, thereby making it possible to simplify the connector attachment operation.

The present invention is carried out as described heretofore and provides the following effectiveness.

According to the connector of the first feature of the invention, the space into which the insertion leg portion of the cover member is inserted is formed in the connector housing, and the waterproof positional misalignment absorbing member is disposed in the space. In addition, the positional misalignment absorbing gap is provided between the insertion leg portion and the outer circumference wall portion or the terminal accommodating main body portion where the connector housing and the cover member are allowed to move relative to each other when the terminal accommodating main body portion of the connector housing is fitted in the mating connector. Thus, with this construction, even if a position misalignment is taking place between the connector housing and the mating connector, the connector housing and the mating connector can move relative to each other to thereby provide a smooth fit of the connector housing in the mating connector.

According to the connector of the second feature of the invention, since the waterproof positional misalignment absorbing member has the bottom sealing portion disposed at the bottom, in addition to the function to absorb a position misalignment between the connectors, the connector can provide the function to shut out water trying to penetrate into the space. In addition, since the waterproof positional misalignment absorbing member has the side sealing portion adapted to be brought into tight contact with the mating connector, it is possible to shut out water trying to penetrate from between the terminal accommodating main body portion fitted in the mating connector and the mating connector.

According to the connector of the third feature of the invention, since the mounting projection provided on the bottom sealing portion is allowed to be inserted through the through hole formed in the bottom, the waterproof positional misalignment absorbing member can securely be positioned at the bottom portion, whereby an inadvertent dislocation of the waterproof positional misalignment absorbing member from the space can be prevented.

According to the connector of the fourth feature of the invention, the insertion space is formed in the accommodating portion in the cover member, the sealing member is disposed in the insertion space and the equipment hood portion having an opening in the front thereof so as to accommodate therein the mating connector secured to the equipment main body is fitted in the same insertion space, whereby the cover member and the equipment hood portion are sealed with the seal member. This construction improves the air-tight state formed between the cover member and the equipment hood portion, thereby making it possible to shut out water trying to penetrate from the Cover member into the interior thereof.

According to the connector of the fifth feature of the invention, the air-tight state formed between the cover member and the equipment hood portion is improved by sealing the cover member and the equipment hood portion with the sealing member provided in the vicinity of the leading end of the equipment hood portion, thereby making it possible to shut out water trying to penetrate from the cover into the interior thereof.

According to the connector of the sixth feature of the invention, even if a plurality of connector housings are provided in the cover member, since the respective connector housings are allowed to move relative to the cover member, as with the first feature of the invention, the connector housings and the cover member move relative to each other so as to absorb the position misalignment, thereby making it possible to realize a smooth fit of the connector housings in the mating connectors.

What is claimed is:

1. A connector comprising:

a connector housing including:

a terminal accommodating main body portion in which a plurality of terminals are partitioned and arranged for accommodation;

an outer circumferential wall portion provided at a predetermined distance away from said terminal accommodating main body portion to surround said terminal accommodating main body portion;

a bottom portion for coupling said outer circumferential wall portion to said terminal accommodating main body portion;

a waterproof positional misalignment absorbing member provided in a space between said terminal accommodating main body portion and said outer circumferential wall portion; and a cover member including:

an insertion leg portion inserted into said space via said waterproof positional misalignment absorbing member;

an accommodating portion having an opening in a front thereof so as to allow said terminal accommodating main body portion to be accommodated therein; and a positional misalignment absorbing gap provided between said insertion leg portion and one of said outer circumferential wall portion and said terminal accommodating main body portion so that said connector housing and said cover member can freely move relative to each other when said terminal accommodating main body portion is fitted in a mating connector, wherein said accommodating portion has an outer circumferential wall surface portion, an inner circumferential wall surface portion provided inwardly of said outer circumferential wall surface portion and an insertion space formed between said outer circumferential wall surface portion and said inner circumferential wall surface portion and further comprising:

a sealing member disposed in said insertion space and an equipment hood portion having an opening in a front thereof so as to accommodate therein a mating connector secured to an equipment main body, said equipment hood portion fitted in said insertion space, wherein said cover member and said equipment hood portion are sealed with said sealing member.

2. A connector comprising:

a connector housing including:

a terminal accommodating main body portion in which a plurality of terminals are partitioned and arranged for accommodation;

an outer circumferential wall portion provided at a predetermined distance away from said terminal accommodating main body portion to surround said terminal accommodating main body portion;

a bottom portion for coupling said outer circumferential wall portion to said terminal accommodating main body portion;

a waterproof positional misalignment absorbing member provided in a space between said terminal accommodating main body portion and said outer circumferential wall portion; and a cover member including:

an insertion leg portion inserted into said space via said waterproof positional misalignment absorbing member;

an accommodating portion having an opening in a front thereof so as to allow said terminal accommodating main body portion to be accommodated therein; and a positional misalignment absorbing gap provided between said insertion leg portion and one of said outer circumferential wall portion and said terminal accommodating main body portion so that said connector housing and said cover member can freely move relative to each other when said terminal accommodating main body portion is fitted in a mating connector, and wherein said accommodating portion has an outer circumferential wall surface portion, an inner circumferential wall surface portion provided inwardly of said outer circumferential wall surface portion and an insertion space formed between said outer circumferential wall surface portion and said inner circumferential wall surface portion and further comprising:

an equipment hood portion having an opening in a front thereof so as to accommodate therein a mating connector secured to an equipment main body, said equipment hood portion fitted in said insertion space, a sealing member provided in the vicinity of a leading end portion of said equipment hood portion to seal said cover member and said equipment hood portion.

3. A connector comprising:

a connector housing including:

a terminal accommodating main body portion in which a plurality of terminals are partitioned and arranged for accommodation, an outer circumferential wall portion provided at a predetermined distance away from said terminal accommodating main body portion to surround said terminal accommodating main body portion;

a bottom portion for coupling said outer circumferential wall portion to said terminal accommodating main body portion;

a waterproof positional misalignment absorbing member provided in a space between said terminal accommodating main body portion and said outer circumferential wall portion; and a cover member including:

an insertion leg portion inserted into said space via said waterproof positional misalignment absorbing member;

an accommodating portion having an opening in a front thereof so as to allow said terminal accommodating main body portion to be accommodated therein; and a positional misalignment absorbing gap provided between said insertion leg portion and one of said outer circumferential wall portion and said terminal accommodating main body portion so that said connector housing and said cover member can freely move relative to each other when said terminal accommodating main body portion is fitted in a mating connector, wherein said waterproof positional misalignment absorbing member includes a bottom sealing portion disposed at said bottom portion, a side sealing portion disposed between said insertion leg portion and one of said terminal accommodating main body portion and said outer circumferential wall portion and so as to be brought into tight contact with a leading end portion of said mating connector and a projection provided on said side sealing portion in such a manner as to project therefrom so as to bias said insertion leg portion, and wherein said accommodating portion has an outer circumferential wall surface portion, an inner circumferential wall surface portion provided inwardly of said outer circumferential wall surface portion and an insertion space formed between said outer circumferential wall surface portion and said inner circumferential wall surface portion and further comprising:

a sealing member disposed in said insertion space and an equipment hood portion having an opening in a front thereof so as to accommodate therein a mating connector secured to an equipment main body, said equipment hood portion fitted in said insertion space, wherein said cover member and said equipment hood portion are sealed with said sealing member.

4. A connector comprising:

a connector housing including:

a terminal accommodating main body portion in which a plurality of terminals are partitioned and arranged for accommodation;

an outer circumferential wall portion provided at a predetermined distance away from said terminal accommodating main body portion to surround said terminal accommodating main body portion;

a bottom portion for coupling said outer circumferential wall portion to said terminal accommodating main body portion;

a waterproof positional misalignment absorbing member provided in a space between said terminal accommodating main body portion and said outer circumferential wall portion; and a cover member including:

an insertion leg portion inserted into said space via said waterproof positional misalignment absorbing member;

an accommodating portion having an opening in a front thereof so as to allow said terminal accommodating main body portion to be accommodated therein; and a positional misalignment absorbing gap provided between said insertion leg portion and one of said outer circumferential wall portion and said terminal accommodating main body portion so that said connector housing and said cover member can freely move relative to each other when said terminal accommodating main body portion is fitted in a mating connector, wherein said waterproof positional misalignment absorbing member includes a bottom sealing portion disposed at said bottom portion, a side sealing portion disposed between said insertion leg portion and one of said terminal accommodating main body portion and said outer circumferential wall portion and so as to be brought into tight contact with a leading end portion of said mating connector and a projection provided on said side sealing portion in such a manner as to project therefrom so as to bias said insertion leg portion, and wherein said accommodating portion has an outer circumferential wall surface portion, an inner circumferential wall surface portion provided inwardly of said outer circumferential wall surface portion and an insertion space formed between said outer circumferential wall surface portion and said inner circumferential wall surface portion and further comprising:

an equipment hood portion having an opening in a front thereof so as to accommodate therein a mating connector secured to an equipment main body, said equipment hood portion fitted in said insertion space, a sealing member provided in the vicinity of a leading end portion of said equipment hood portion to seal said cover member and said equipment hood portion.

5. A connector comprising:

a connector housing including:

a terminal accommodating main body portion in which a plurality of terminals are partitioned and arranged for accommodation;

an outer circumferential wall portion provided at a predetermined distance away from said terminal accommodating main body portion to surround said terminal accommodating main body portion;

a bottom portion for coupling said outer circumferential wall portion to said terminal accommodating main body portion;

a waterproof positional misalignment absorbing member provided in a space between said terminal accommodating main body portion and said outer circumferential wall portion; and a cover member including:

an insertion leg portion inserted into said space via said waterproof positional misalignment absorbing member;

an accommodating portion having an opening in a front thereof so as to allow said terminal accommodating main body portion to be accommodated therein; and a positional misalignment absorbing gap provided between said insertion leg portion and one of said outer circumferential wall portion and said terminal accommodating main body portion so that said connector housing and said cover member can freely move relative to each other when said terminal accommodating main body portion is fitted in a mating connector, wherein said waterproof positional misalignment absorbing member includes a bottom sealing portion disposed at said bottom portion, a side sealing portion disposed between said insertion leg portion and one of said terminal accommodating main body portion and said outer circumferential wall portion and so as to be brought into tight contact with a leading end portion of said mating connector and a projection provided on said side sealing portion in such a manner as to project therefrom so as to bias said insertion leg portion, wherein said waterproof positional misalignment absorbing member has a mounting projection provided on said bottom sealing portion and is disposed in said space with said mounting projection being inserted into a through hole formed in said bottom portion, and wherein said accommodating portion has a n outer circumferential wall surface portion, an inner circumferential wall surface portion provided inwardly of said outer circumferential wall surface portion and an insertion space formed between said outer circumferential wall surface portion and said inner circumferential wall surface portion and further comprising:

a sealing member disposed in said insertion space and an equipment hood portion having an opening in a front thereof so as to accommodate therein a mating connector secured to an equipment main body, said equipment hood portion fitted in said insertion space, wherein said cover member and said equipment hood portion are sealed with said sealing member.

6. A connector comprising:

a connector housing including:

a terminal accommodating main body portion in which a plurality of terminals are partitioned and arranged for accommodation;

an outer circumferential wall portion provided at a predetermined distance away from said terminal accommodating main body portion to surround said terminal accommodating main body portion;

a bottom portion for coupling said outer circumferential wall portion to said terminal accommodating main body portion;

a waterproof positional misalignment absorbing member provided in a space between said terminal accommodating main body portion and said outer circumferential wall portion; and a cover member including:

an insertion leg portion inserted into said space via said waterproof positional misalignment absorbing member;

an accommodating portion having an opening in a front thereof so as to allow said terminal accommodating main body portion to be accommodated therein; and a positional misalignment absorbing gap provided between said insertion leg portion and one of said outer circumferential wall portion and said terminal accommodating main body portion so that said connector housing and said cover member can freely move relative to each other when said terminal accommodating main body portion is fitted in a mating connector, wherein said waterproof positional misalignment absorbing member includes a bottom sealing portion disposed at said bottom portion, a side sealing portion disposed between said insertion leg portion and one of said terminal accommodating main body portion and said outer circumferential wall portion and so as to be brought into tight contact with a leading end portion of said mating connector and a projection provided on said side sealing portion in such a manner as to project therefrom so as to bias said insertion leg portion, wherein said waterproof positional misalignment absorbing member has a mounting projection provided on said bottom sealing portion and is disposed in said space with said mounting projection being inserted into a through hole formed in said bottom portion, and wherein said accommodating portion has an outer circumferential wall surface portion, an inner circumferential wall surface portion provided inwardly of said outer circumferential wall surface portion and an insertion space formed between said outer circumferential wall surface portion and said inner circumferential wall surface portion and further comprising:

an equipment hood portion having an opening in a front thereof so as to accommodate therein a mating connector secured to an equipment main body, said equipment hood portion fitted in said insertion space, a sealing member provided in the vicinity of a leading end portion of said equipment hood portion to seal said cover member and said equipment hood portion.

* * * * *